US007086671B2

(12) United States Patent
Spurr

(10) Patent No.: US 7,086,671 B2
(45) **Date of Patent: *Aug. 8, 2006**

(54) LATCH

(75) Inventor: Nigel Victor Spurr, Birmingham (GB)

(73) Assignee: Meritor Light Vehicle Systems (UK) Limited, Birmingham (GB)

( * ) Notice: Subject to any disclaimer, the term of this patent is extended or adjusted under 35 U.S.C. 154(b) by 53 days.

This patent is subject to a terminal disclaimer.

(21) Appl. No.: 10/419,017

(22) Filed: Apr. 18, 2003

(65) Prior Publication Data

US 2003/0199223 A1 Oct. 23, 2003

Related U.S. Application Data

(62) Division of application No. 09/654,234, filed on Sep. 2, 2000, now Pat. No. 6,592,157.

(30) Foreign Application Priority Data

Sep. 4, 1999 (GB) ..... 9920869.6

(51) Int. Cl.
*E05C 3/06* (2006.01)

(52) U.S. Cl. ..... 292/216; 292/DIG. 23

(58) Field of Classification Search ..... 292/336.3, 292/216, 201, DIG. 23; 70/264
See application file for complete search history.

(56) References Cited

U.S. PATENT DOCUMENTS

| | | | | |
|---|---|---|---|---|
| 3,858,919 | A * | 1/1975 | Kleefeld et al. | 292/216 |
| 4,097,077 | A * | 6/1978 | Gahrs | 292/216 |
| 5,427,421 | A * | 6/1995 | Hamaguchi | 292/216 |
| 5,445,423 | A * | 8/1995 | Mader | 292/336.3 |
| 5,803,515 | A * | 9/1998 | Arabia et al. | 292/216 |
| 5,844,470 | A | 12/1998 | Garnault et al. | |
| 6,050,620 | A * | 4/2000 | Rogers et al. | 292/216 |
| 6,286,878 | B1 | 9/2001 | Hochart et al. | |
| 6,367,296 | B1 | 4/2002 | Dupont | |
| 6,592,157 | B1 * | 7/2003 | Spurr | 292/216 |

FOREIGN PATENT DOCUMENTS

| | | |
|---|---|---|
| DE | 4005641 A1 | 8/1990 |
| DE | 41 29 706 | 3/1993 |
| DE | 19807384 A1 | 8/1999 |
| EP | 0331832 | 5/1988 |
| EP | 0 304 357 | 2/1989 |
| EP | 0879930 A1 | 5/1998 |
| EP | 00307599 | 1/2001 |

OTHER PUBLICATIONS

Communication of a Notice of Opposition dated Feb. 23, 2005.

* cited by examiner

*Primary Examiner*—Gary Estremsky
(74) *Attorney, Agent, or Firm*—Carlson, Gaskey & Olds

(57) ABSTRACT

An entry door lock system includes an energy storage device (27) to permit unlatching if unlatching movement of a door handle occurs before the latch has been unlocked. The device (27) is passive if unlocking occurs before unlatching movement of the door handle. The invention avoids the need for repeat movement of the door handle in cases where unlocking follows initial door handle movement.

21 Claims, 4 Drawing Sheets

LATCH

This application is a divisional and claims priority to U.S. patent application Ser. No. 09/654,234, filed Sep. 2, 2000, now U.S. Pat. No. 6,592,157 which claims priority to Great Britain Patent Application No. 9920869.6, filed on Sep. 4, 1999.

BACKGROUND OF THE INVENTION

This invention relates to a latch for doors and the like, and particularly to a door latch of a vehicle.

Known passive entry type car door lock systems work by the driver having about his person a radio frequency card which, as he approaches his own vehicle, is recognized by the vehicle and the vehicle then unlocks itself. On certain passive entry systems the recognition process only starts when an outside door handle is initially moved by the driver. Under such circumstances the electrical power actuator which unlocks the door does so in a fraction of a second and before the door handle has been fully lifted, thus allowing the opening of the door.

However, if the door handle is lifted quickly it can beat the unlocking actuator leaving the door locked with the handle in the up position. The driver must release the handle and then lift it again to open the door, and this can be frustrating to some drivers.

One known solution to this problem is to provide an actuator which both unlocks and also unlatches a door latch. However, significantly more power is required to unlatch than to unlock thus requiring a bigger actuator.

SUMMARY OF THE INVENTION

According to the invention there is provided a latch comprising a housing, a locking member of the housing movable between locked and unlocked conditions, a latch release member of the housing movable between closed and open conditions and a latching member of the housing movable between latched and unlatched conditions, movement of the latch release member to the open condition causing movement of the latching member to the unlatched condition when the locking member is in the unlocked condition, and movement of the latching member to the unlatched condition being prevented when the locking member is in the locked condition, wherein an energy storage device is provided between the latch release member and said latching member, and a blocking member of the housing is movable from a disengaged condition to an engaged condition in which movement of said latching member to the unlatched condition is prevented when the locking member is in the locked condition, movement of the latch release member to the open condition causing said energy storage means to bias said latching member to the watched condition when said blocking member is in the engaged condition, movement of said blocking device to the disengaged condition permitting movement of said latching member to the unlatched condition under the action of said bias.

The present invention overcomes the prior art problems by storing energy in e.g. an unlatching spring. If the driver opens the door handle quickly, the spring energy is used to unlatch after the power actuators have unlocked the door. If the driver opens the door handle slowly then the spring is not required to store or release energy.

Preferably the locking member, latching member, latch release member and blocking member are pivotally mounted on said housing. In the preferred embodiment, the blocking member is movable in the opposite sense to the locking member. The latching member and latch release member may be pivoted about the same axis. The energy storage device may be a tension spring.

The locking member may include a force transmission element insertable between the latching member and the latch releasing member in order to transmit motion therebetween in the unlocked condition.

BRIEF DESCRIPTION OF THE DRAWINGS

Other features will be apparent from the following description of a preferred embodiment shown by way of example only in the accompanying drawings, in which.

DETAILED DESCRIPTION OF THE PREFERRED EMBODIMENT

Figure 2:
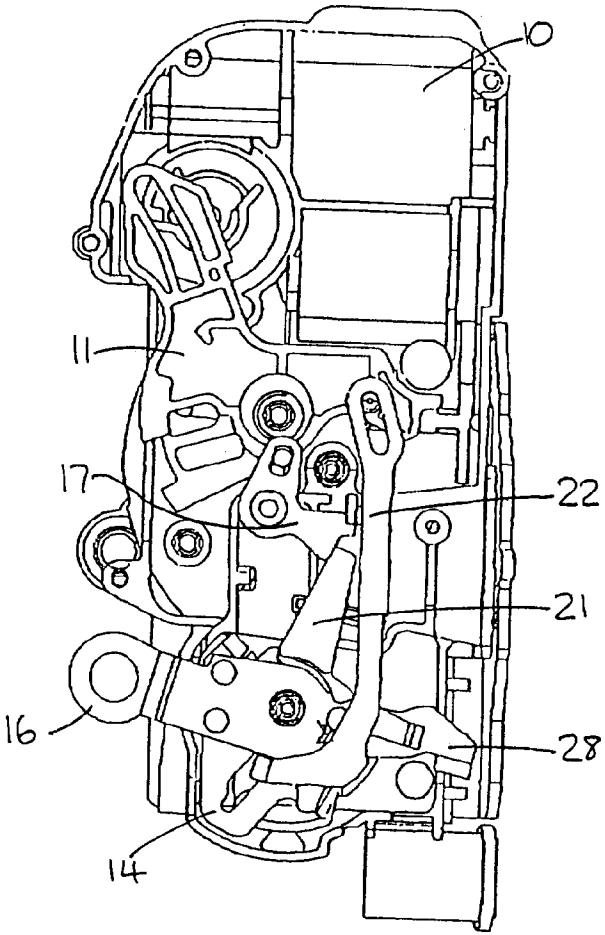
FIG. 2 shows the mechanism of FIG. 1 in the locked and latched condition.

Numerous parts are illustrated in the drawings accompanying this specification, however only those parts necessary for understanding the present invention are explained in detail.

Figure 9:
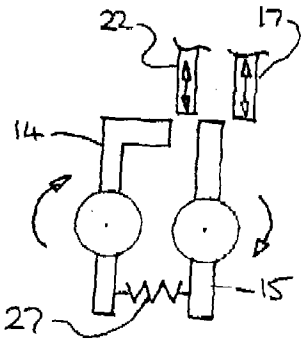
FIG. 9 is a schematic representation of a mechanism according to the invention.
Figure 8:
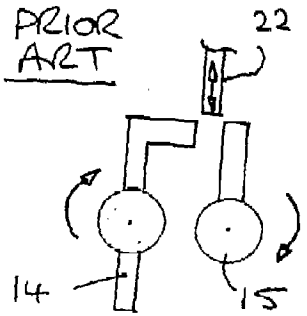
PRIOR ART Fig 8
FIG. 8 is a schematic representation of a prior art mechanism.

The invention is illustrated schematically with reference to FIGS. 8 and 9.

The known arrangement of FIG. 8 includes a pivotable release lever 14, and a pivotable cam lifter 15. A locking link 22 is insertable between the lever 14 and lifter 15. When the link 22 is inserted, the lever 14 can transmit motion to the lifter 15 to release the door latch. When the link is withdrawn, the arcuate range of movement of the lever is insufficient to move the lifter; accordingly in this condition the latch cannot be released by the lever 14.

FIG. 9 illustrates the invention. A blocking device 17 is movable to prevent releasing movement of the lifter 15. The lever 14 and lifter 15 are however linked by a spring 27. In this configuration, the lever 14 is still unable to actuate the lifter when in the locked condition (link 22 withdrawn). However the lifter is placed under load via the spring 27 such that if the blocking device is withdrawn, the lifter will rotate to latch the door.

Thus a repeat motion of the door release lever to permit insertion of the locking link 22 is not necessary.

With reference to FIGS. 1–7, a preferred embodiment of a door latch mechanism comprises a housing 10 having a locking member in the form of a locking lever 11 pivotable therein about an axis A extending perpendicularly to the plane of the drawing. The lever is pivotable, typically under the action of an electrical actuator, and has upright pegs 12,13 for attachment to other parts of the mechanism, to be described below.

A latch release member in the form of a release lever 14 is pivotable about an axis B extending perpendicularly to the plane of the drawing. Also pivotable about axis B are a latching member in the form of a pawl lifter 15 and an outside handle lever 16. The levers 14,16 and pawl lifter 15 are engageable in various ways for movement together, as will become apparent.

A blocking member in the from of a pawl lifter blocking lever 17 is pivotable about a third axis C, parallel to axes A and B, and has two arms 18,19. The first arm 18 is slotted and is engaged with peg 12 such that anti-clockwise movement of locking lever 11 results in clockwise movement of blocking lever 17, and vice-versa. The second arm 19 constitutes a blocking member movable into and out of engagement with a blocking arm 21 of the pawl lifter 15.

A locking link 22 is slotted at one end 23 to engage the upright peg 13, and has a depending leg 24 insertable between the release lever 14 and pawl lifter 15 in order to transmit movement therebetween.

Figure 5:
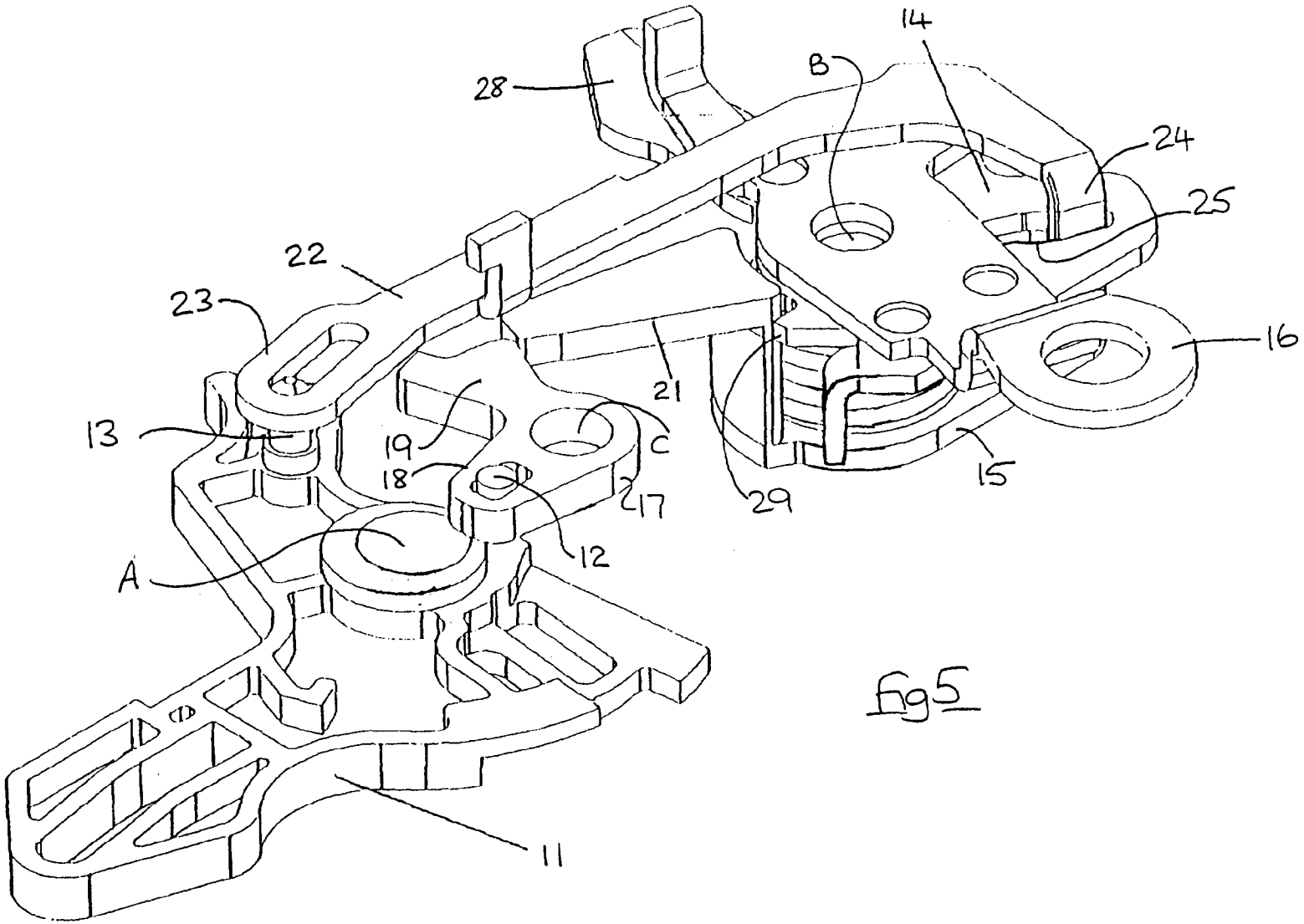
FIG. 5 is an enlarged perspective view of the latch components comprising the invention.
Figure 7:
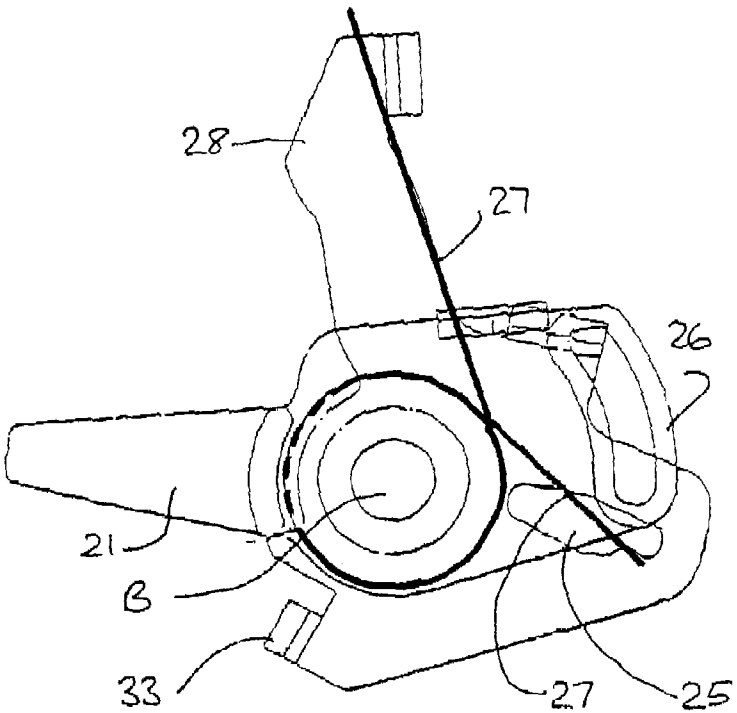
FIG. 7 is a plan view of the components illustrated in FIG. 6.
Figure 6:
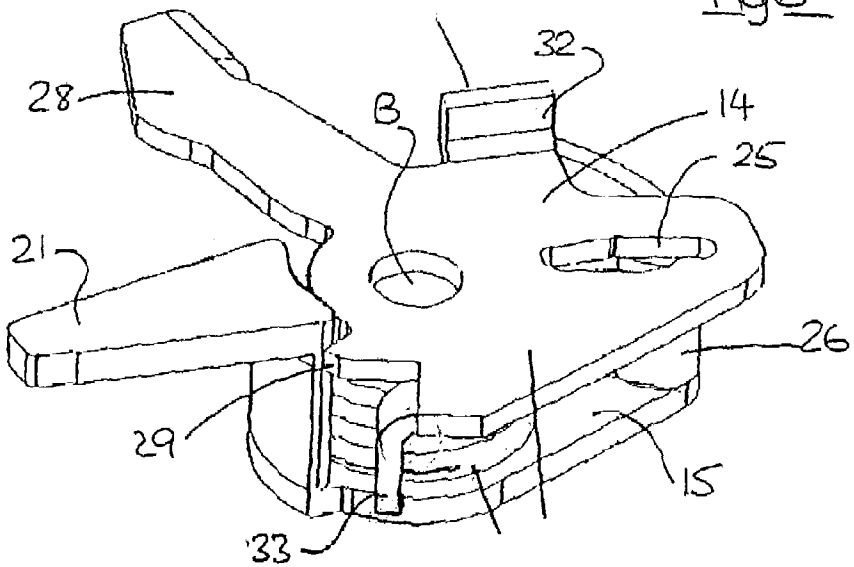
FIG. 6 is an enlarged perspective view of the pawl lifter and release arm of the invention.

As illustrated in FIG. 5, the leg 24 passes through a slot 25 of the release lever, and is engageable with an upstanding abutment 26 of the pawl lifter 15 (FIG. 6).

An energy storage device in the form of hairpin spring 27 located about axis B has free ends bearing on a release lever arm 28 and the pawl lifter abutment 26, thereby to urge the release lever arm 28 and pawl lifter blocking arm 21 apart (FIG. 6).

A release lever abutment 29 is engageable with the pawl lifter blocking arm 21 to restrict clockwise movement of the release lever relative to the pawl lifter.

Figure 1:
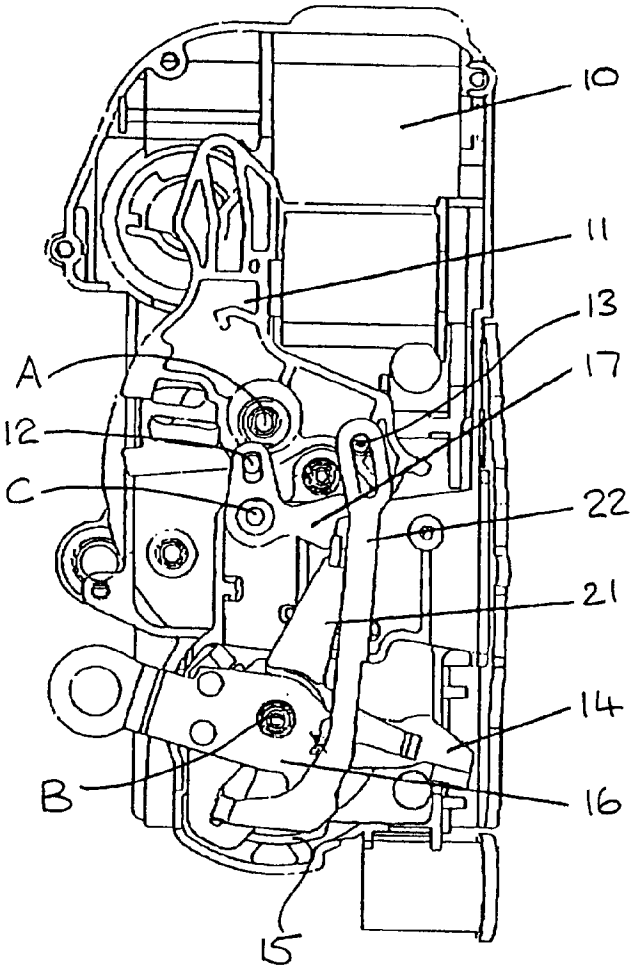
FIG. 1 shows in plan a vehicle door latch mechanism according to the present invention, and in the unlocked and latched condition.
Figure 4:
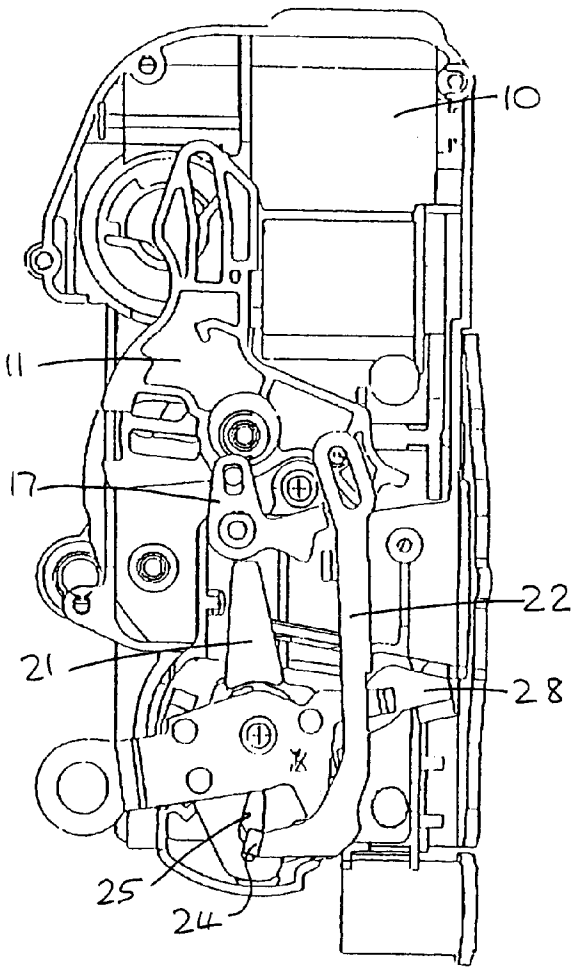
FIG. 4 shows the mechanism of FIG. 3 in the unlocked condition and with unlatching completed.
Figure 3:
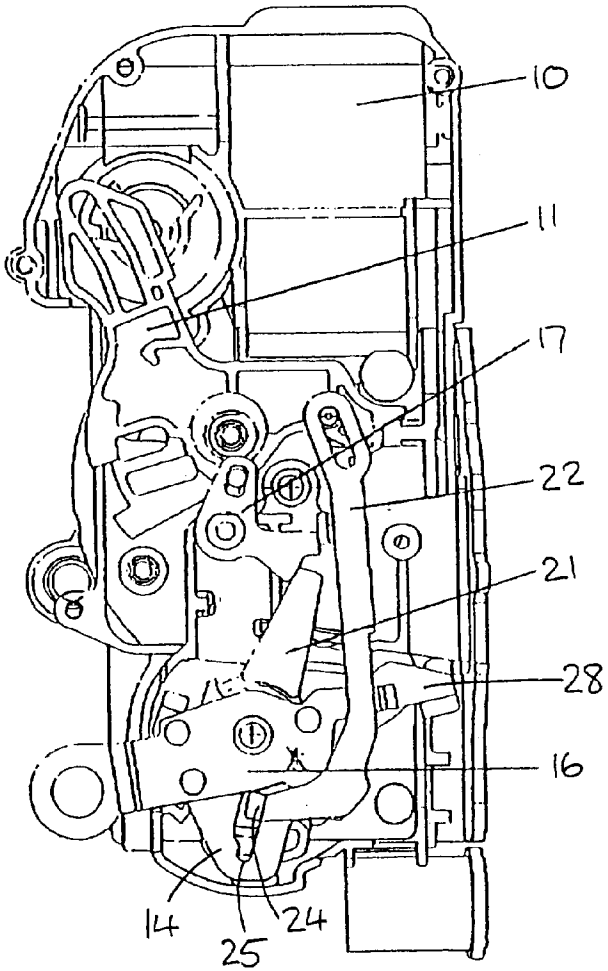
FIG. 3 shows the mechanism of FIG. 1 in the locked condition with unlatching attempted.

In order to return the release lever 14 to the unlatched condition of FIG. 1, a second hairpin spring (not shown) acts about axis B between the housing 10 and a return arm 33 of the release arm.

In use arcuate movement of the pawl lifter 15 disengages the door latch in order to permit the vehicle door to be opened. The release lever arm 28 of the release lever is in use connected to an internal door handle, and an external release am 32 of the pawl lifter 15 is in use engageable with the external door handle lever 16. Different release arms ensure independent movement, in a known manner.

Operation of the latch mechanism is as follows:

FIG. 1 shows the door latch in the unlocked condition. The blocking lever 17 is pivoted anti-clockwise out of possible engagement with the pawl lifter blocking arm 21. The peg 13 is clockwise to the maximum extent and the locking link is urged downwards (as viewed), for example by a light spring (not shown). In this condition the leg 24 is between the release lever 14 and the pawl lifter abutment 26; accordingly anti-clockwise movement of the release lever 14 is transmitted directly to the pawl lifter 15, which also moves anti-clockwise since the blocking arm 21 is unobstructed. Thus the door latch is released, and the components assume the configuration illustrated in FIG. 4.

It will be noted that the bottom part of the release lever slot 25 (as viewed) is narrowed somewhat so that the leg 24 is a relatively tight fit; this reduces lost motion in the mechanism.

FIG. 2 shows the latch mechanism in the locked condition. The locking lever 11 is pivoted anti-clockwise, thus pivoting the blocking lever 17 clockwise so as to obstruct anti-clockwise movement of the blocking arm 21. The locking link 22 is lifted out of engagement with the abutment 26, and accordingly direct mechanical actuation of the pawl lifter 15 by the release lever 14 is not possible.

If in this condition the release lever 14 is pivoted, the hairpin spring 27 is stressed, and urges the pawl lifter 15 anti-clockwise; movement is however prevented by the blocking lever 17 and the door cannot be unlatched. This condition occurs in use when the door handle is moved to the open condition, but the lock actuator has not been energized, or has not been energized sufficiently in advance.

If however the lock actuator is energized whilst the door handle is in the open condition, the locking lever pivots clockwise, thus releasing engagement of the blocking lever 17 and blocking arm 21. As a consequence, the pawl lifter rotates anti-clockwise under the action of the hairpin spring 27, and the door is unlatched.

Downwards movement of the locking link 22 is prevented by the abutment 26 until pivoting of the pawl lifter 15 has occurred. However the slot in the upper end of the locking link 22 permits the necessary pivoting of the locking lever 11 and peg 13, and eventually the link 22 is permitted to move down as the pawl lifter pivots to the latch released condition illustrated in FIG. 4.

The invention thus provides an economical and uncomplicated means of overcoming the problem of rapid door handle movement. Furthermore the invention can readily be applied to existing mechanism if required. In the preferred embodiment, the additional components required are hairpin spring 27 and associated spring reaction members, and blocking lever 17.

The invention claimed is:

1. A latch comprising:

a housing;

a locking member supported by the housing and movable between a locked condition and an unlocked condition;

a latch release member supported by the housing and movable between a closed condition and an open condition;

a latching member supported by the housing and movable between a latched condition and an unlatched condition;

an energy storage device interconnecting the latch release member and the latching member;

a blocking member supported by the housing and movable by the locking member from a disengaged condition to an engaged condition; and a lock link moveable by the locking member into a space between the latching member and the latch release member to transmit motion therebetween to define an unlocked position of the lock link and moveable by the locking member from the space between the latching member and the latch release member to define a locked position of the lock link, wherein movement of the latch release member to the open condition causes the latch release member to engage and move the lock link, which engages and moves the latching member to the unlatched condition when the locking member is in the unlocked condition, wherein movement of the latching member to the unlatched condition is prevented when the locking member is in the locked condition and the lock link is in the locked position, movement of the latch release member to the open condition causes the energy storage device to generate a biasing force to move the latching member to the unlatched condition when the blocking member is in the engaged position, and movement of the blocking member to the disengaged condition permits movement of the latching member to the unlatched condition under the action of the biasing force.

2. The latch according to claim 1, wherein the locking member is pivotable about a first axis relative to the housing.

3. The latch according to claim 1, wherein the energy storage device comprises a coil spring.

4. The latch according to claim 1, wherein the blocking member is moveable by the locking member from the disengaged condition to the engaged condition.

5. A latch comprising:

a housing;

a locking member supported by the housing and movable between a locked condition and an unlocked condition, wherein the locking member is pivotable about a first axis relative to the housing;

a latch release member supported by the housing and movable between a closed condition and an open condition;

a latching member supported by the housing and movable between a latched condition and an unlatched condition, wherein movement of the latch release member to the open condition causes movement of the latching member to the unlatched condition when the locking member is in the unlocked condition and movement of the latching member to the unlatched condition is prevented when the locking member is in the locked condition, wherein the latching member and the latch release member are pivotable about a second axis relative to the housing;

an energy storage device interconnecting the latch release member and the latching member; and a blocking member supported by the housing and movable from a disengaged condition to an engaged condition, wherein movement of the latching member to the unlatched condition is prevented when the locking member is in the locked condition, movement of the latch release member to the open condition causes the energy storage device to generate a biasing force to move the latching member to the unlatched condition when the blocking member is in the engaged condition, and movement of the blocking member to the disengaged condition permits movement of the latching member to the unlatched condition under the action of the biasing force.

6. The latch according to claim 5, wherein the blocking member is pivotable about a third axis relative to the housing.

7. The latch according to claim 6, wherein the blocking member is pivotable relative to the housing in an opposite direction to the movement of the locking member.

8. A method of unlatching a door comprising the steps of:

moving a door handle to an open condition with a door latch in a locked condition and a latched condition;

generating a biasing force with a spring in response to the step of moving the door handle;

actuating the door latch from the locked condition to an unlocked condition with the door handle in the open condition subsequent to the step of generating the biasing force; and applying the biasing force to move the door latch from the latched condition to an unlatched condition subsequent to the step of actuating the door latch.

9. The method according to claim 8, further including a step of obstructing a blocking arm of a latching member with a blocking member prior to the step of moving the door handle.

10. The method according to claim 9, further including a step of lifting a lock link out of engagement with an abutment of the latching member prior to the step of moving the door handle.

11. The method according to claim 9, further including a step of moving a lock link into engagement with an abutment of the latching member.

12. The method according to claim 8, wherein the step of moving the door handle includes moving a door handle lever to an open position.

13. The method according to claim 8, wherein the step of generating the biasing force includes moving a latch release member to load the spring and apply the biasing force against a latching member.

14. The method according to claim 13, wherein the step of generating the biasing force includes storing the biasing force with the spring until the biasing force is released by the step of actuating the door latch.

15. The method according to claim 8, wherein the step of actuating the door handle includes moving a locking member with a power actuator, thereby moving a blocking member away from a blocking arm of a latching member.

16. The method according to claim 15, wherein the step of applying the biasing force includes moving the latching member with the biasing force.

17. The method according to claim 15, wherein the power actuator is an electrical power actuator.

18. The method according to claim 8, wherein the door latch includes a housing, a locking member supported by the housing and movable between the locked condition and the unlocked condition, a latch release member supported by the housing and movable between a closed condition and an open condition, a latching member supported by the housing and movable between the latched condition and the unlatched condition, a blocking member supported by the housing and movable from a disengaged condition to an engaged condition, wherein the spring interconnects the latch release member and the latching member, and the step of generating the biasing force comprises the steps of:

generating the biasing force with the spring on the latching member that tends to bias the latching member towards the unlatched condition, and blocking movement of the latching member to the unlatched condition with the blocking member, wherein the steps of generating the biasing force with the spring on the latching member and blocking movement of the latching member are performed while the blocking member is in the engaged condition, the locking member is in the locked condition, the latch release member is in the open condition and the latching member is in the latched condition.

19. The method according to claim 18, wherein the step of applying the biasing force comprises:

moving the latch release member to the open condition with the blocking member in the disengaged condition and the locking member in the unlocked condition, and moving the blocking member to the disengaged condition with the locking member in the unlocked condition and the latch release member in the open condition, wherein the steps of moving the latch release member and moving the blocking member cause the biasing force to move the latching member to the unlatched condition.

20. The method according to claim 8, further including a step of inserting a lock link in a space between a latching member and a latch release member to transmit motion therebetween and withdrawing the lock link from the space between the latching member and the latch release member.

21. A latch comprising:

a housing;

a locking member supported by the housing and movable between a locked condition and an unlocked condition;

a latch release member supported by the housing and movable between a closed condition and an open condition;

a latching member supported by the housing and movable between a latched condition and an unlatched condition, a blocking member supported by the housing and movable by the locking member from a disengaged condition to an engaged condition;

an energy storage device interconnecting the latch release member and the latching member; and a lock link moveable by the locking member into a space between the latching member and the latch release member to transmit motion therebetween and define an unlocked position of the lock link and moveable by the locking member from the space between the latching member and the latch release member to define a locked position of the lock link, wherein with the blocking member in the disengaged condition, the locking member in the unlocked condition and the lock link in the unlocked position, movement of the latch release member to the open condition causes the latch release member to engage and move the lock link, which engages and moves the latching member to the unlatched condition, wherein with the blocking member in the engaged condition, the locking member in the locked condition, the lock link in the unlocked position, the latch release member in the open condition and the latching member in the latched condition, the energy storage device generates a biasing force on the latching member tending to bias the latching member towards the unlatched condition and movement of the latching member to the unlatched condition is blocked by the blocking member, and wherein subsequent movement of the blocking member to the disengaged condition while the locking member remains in the unlocked condition, the lock link remains in the unlocked position and the latch release member remains in the open condition causes the biasing force to move the latching member to the unlatched condition.

* * * * *